US005174512A

United States Patent [19]

Orlandi

[11] Patent Number: 5,174,512

[45] Date of Patent: Dec. 29, 1992

[54] GRINDING PROCESS AND A CONTINUOUS HIGH-CAPACITY MICRONIZING MILL FOR ITS IMPLEMENTATION

[75] Inventor: Tarcisio Orlandi, Fano, Italy

[73] Assignee: Snamprogetti S.p.A., Milan, Italy

[21] Appl. No.: 723,715

[22] Filed: Jun. 18, 1991

Related U.S. Application Data

[63] Continuation of Ser. No. 448,890, Dec. 12, 1989, abandoned.

[30] Foreign Application Priority Data

Dec. 16, 1988 [IT] Italy ..... 22989 A/88

[51] Int. Cl.[5] ..... B02C 17/00

[52] U.S. Cl. ..... 241/72; 241/153; 241/184

[58] Field of Search ..... 241/72, 153, 179, 24, 241/79.1, 80, DIG. 14, 184

[56] References Cited

U.S. PATENT DOCUMENTS

| | | | |
|---|---|---|---|
| 1,636,138 | 7/1927 | Köppen et al. | 241/72 |
| 1,739,855 | 12/1929 | Newhouse | 241/72 X |
| 1,748,920 | 2/1930 | Newhouse | 241/72 X |
| 1,793,998 | 2/1931 | Kramer | 241/DIG. 14 |
| 1,846,209 | 2/1932 | Kramer | 241/DIG. 14 |
| 2,297,804 | 10/1942 | Siegfried | 241/179 X |
| 3,601,323 | 8/1971 | Giencke | 241/179 X |
| 3,877,650 | 4/1975 | Comford | 241/72 X |
| 3,964,717 | 6/1976 | Hansen | 241/153 X |
| 4,193,554 | 3/1980 | Ansen et al. | 241/79.1 |
| 4,498,634 | 2/1985 | Nelson et al. | 241/72 |

FOREIGN PATENT DOCUMENTS

| | | |
|---|---|---|
| 1285277 | 12/1968 | Fed. Rep. of Germany . |
| 2207484 | 9/1972 | Fed. Rep. of Germany . |
| 278214 | 10/1927 | United Kingdom . |

*Primary Examiner*—Mark Rosenbaum
*Assistant Examiner*—Frances Chin
*Attorney, Agent, or Firm*—Shea & Gould

[57] ABSTRACT

A continuous micronizing mill for granular material consisting of a rotary drum with a high length/diameter ratio, divided by separator baffles into several grinding chambers in which grinding loads having a progressively decreasing body size are placed and in which the ratios of granular material to grinding load are different.

14 Claims, 4 Drawing Sheets

GRINDING PROCESS AND A CONTINUOUS HIGH-CAPACITY MICRONIZING MILL FOR ITS IMPLEMENTATION

This is a continuation of application Ser. No. 07/448,890, filed Dec. 12, 1989, now abandoned This invention relates to a high-capacity tubular micronizing mill operating on a continuous cycle.

The dry or wet grinding of solid granular products for their size reduction is one of the most widespread industrial operations both for high-capacity production of low added value, typically in the mining and building industries, and for low-capacity production of very high added value, typically in the fine chemical, pharmaceutical and cosmetics industries.

To obtain ultrafine products with a less than 10 micron particle size, this second category is able to sustain high energy and processing costs, which however are unsustainable in the case of products of low added value.

On an industrial scale, high-capacity grinding of the order of 10 t/h and above is conducted in rotary tubular mills partly filled with a grinding load consisting of impact-resistant regular solids, which are generally metal balls but can be of other shape and type such as metal cylinders or bars, or regular stones. It is known that for a certain speed of the tubular mill, which is known as the critical speed and is expressed by the equation:

$$\omega_{cr} = \frac{42.3}{\sqrt{D}}$$

where $\omega$ is the mill r.p.m. and D is its inner diameter in metres, the grinding load begins to be centrifuged. The grinding load produces its maximum work for a speed equal to about 85% of the critical speed.

This type of mill can attain comminution ratios exceeding 100, but the best efficiencies are obtained for comminution ratios, i.e. particle size reductions, of about 25–30.

Generally, continuous-cycle high-capacity tubular mills are able to provide a ground product with a particle size distribution of between 0 and 64 microns, but not finer. If finer products are required, then different grinders must be used, such as microsphere mills or compressed air micronizers, which are of much lower capacity —not more than 1000 kg/h —and of very high energy consumption. Such grinders are used for example in the dyestuffs, pesticide or ink industries where ultrafine particle size distributions of 0–20 microns and sometimes 0–10 microns are required.

The present invention enables the limitations of the equipment of the known art to be overcome by a dry or wet-operating continuous process able to produce with high unit capacity a ground product of particle size of less than 20 microns, with low energy consumption.

BRIEF DESCRIPTION OF THE PREFERRED EMBODIMENT

The micronizing mill of the present invention consists of a multi-chamber tubular mill, described hereinafter with reference to FIG. 1 which shows a typical embodiment thereof by way of non-limiting example.

The described embodiment relates to the grinding of coal to obtain powder having a particle size suitable for its use in stable high-concentration aqueous suspensions directly usable as fuels in industrial burners.

Figure 1:
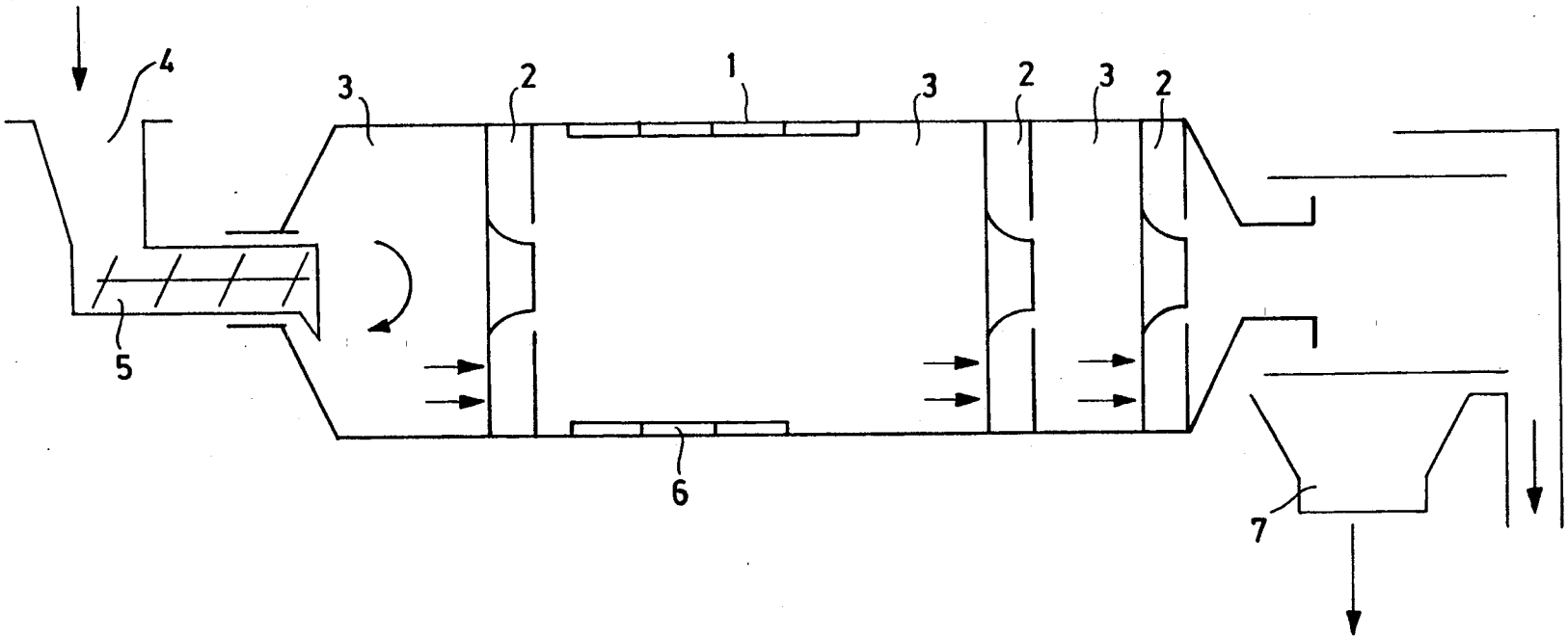
FIG. 1 is a schematic illustration of a side view of a micronizing mill.

The micronizing mill according to the invention is in the form of a rotary drum 1 with a high ratio of length to inner diameter, this ratio being at least 5 and preferably 6 or more, its internal volume being divided by separator baffles 2 into a plurality of cylindrical grinding chambers 3, in which are placed grinding loads, the constituents of which are of decreasing size in progressing from the feed chamber to the discharge chamber. The shape of the separator baffles 2 is shown in greater detail in FIGS. 2A and 2B. Feed is by means of a hopper device 4 with a rotary screw feeder 5, known in the art. The speed of rotation of the screw feeder 5 determines the throughput.

Inside the cylindrical chambers 3 there are placed the grinding loads consisting of metal, e.g. steel, balls or rods.

The grinding load constituents are of decreasing size in progressing from the initial chamber which receives the feed, to the final chamber from which the micronized product is discharged. According to the present invention it has been found that optimum efficiency is obtained by placing in each chamber, and especially in the initial chambers, grinding loads consisting of bodies which are not all of the same size but of a size distribution such as to obtain the maximum number of possible collisions between the product and the grinding load, and having unit kinetic energies, at least for part of the grinding load, which are sufficient for comminuting the granules of largest size.

The size distribution of the grinding loads has to be correlated with the particle size distribution of the feed. The walls of the grinding chambers 3 are provided with grooved armour cladding 6 which not only provides the necessary protection but also determines the mixing and advancement of the material being ground and rotates the grinding bodies which rise circularly along the grooved wall to a certain height, related directly to the speed of rotation, and then fall down through a parabolic trajectory onto the layer of granules, to effect their comminution. According to a preferred embodiment of the invention the rotary drum 1 is divided into three cylindrical chambers 3, of which the centre chamber is much longer than the other two. The purpose of the first grinding chamber is to reduce the particle size of the coarsest part of the feed, the more spacious central chamber performing most of the work, while the last chamber completes the comminution.

The micronized product is discharged from the last cylindrical chamber by the blades of the baffle and is conveyed to storage via the hopper 7, as known in the art. One of the essential components of the micronizing mill according to the invention is the separator baffle which acts both as a wall between the various chambers 3 and as a level controller for the product. It is shown in FIGS. 2 A and B.

The separator baffle consists of a outer ring 11 for its fixing to the tubular wall of the rotary drum 1 and two circular flat frontal walls 12 and 13 which face adjacent grinding chambers 3 between which the product is transferred proceeding from left to right.

In that wall 12 facing the upstream grinding chamber there are provided circular slots 14 through the inner circular band, whereas the peripheral circular band is without slots. At the centre of the baffle there is positioned a flared solid body such as the cone frustum 15, with its minor base facing the downstream grinding chamber. In the wall 13 facing the downstream grinding chamber there is a central circular hole coaxial to the conical body 15, to allow material discharge.

Inside the hollow disc defined by the walls 12 and 13 there are located, in addition to the conical body 15, a plurality of blades 16 which transfer the product between the grinding chambers. The operation of the mill according to the invention is substantially the same for dry grinding as for wet grinding, in which the solid is in concentrated suspension in a liquid phase.

As the mill rotates, the circular slots 14 in the circular sectors which have moved into a lower position allow passage of the turbid liquid in the case of wet grinding, or powder in the case of dry grinding, from the upstream grinding chamber into the inner recess of the baffle defined by the walls 12 and 13 and ring 11, and containing the blades 16, where it collects in accordance with the arrows. The sectors containing the turbid liquid or powder accumulated in the recesses continue to rotate and pass from the lower position to the upper position, the turbid liquid or powder retained by the blades 16 falling by gravity onto the conical body 15 and passing through the central circular hole in the wall 13 into the downstream grinding chamber located to the right of FIG. 2B. The flared body 15 can also be in the form of a truncated right pyramid of regular polygonal base.

Figure 2B:
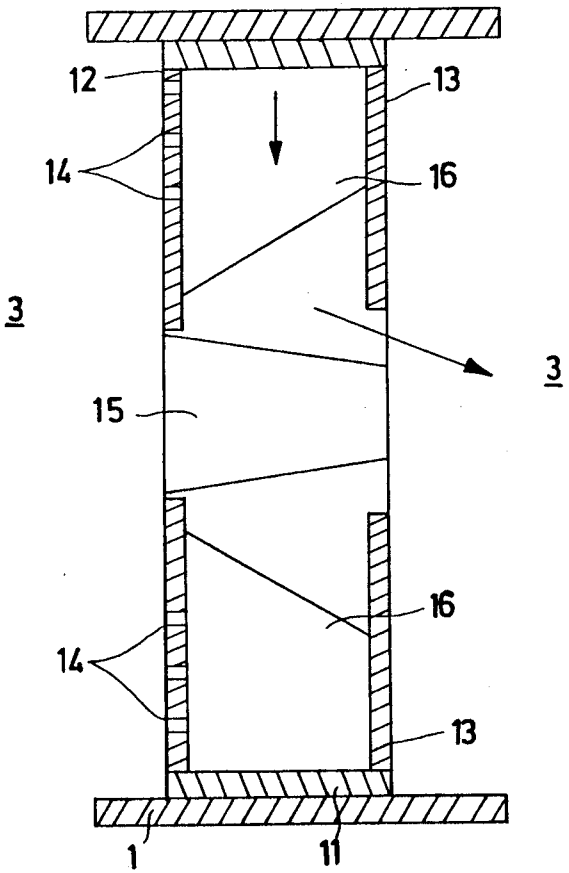
FIG. 2B is a side view of the baffle illustrated in FIG. 2A.

The blade 16 can be formed with flat walls of C profile or with curved scoop-shaped walls. It can extend completely between the ring 11 and the flared body 15 to isolate the circular sectors from each other, or can leave by-pass gaps in the central zone as shown in FIG. 2B or in the peripheral zone in proximity to the ring 11, so reducing the rate of effective transfer per revolution from one chamber to the next.

In this respect, it should be noted that the required throughput of the mill is normally much less than the transfer capacity of the blades 16 if the circular sectors are completely isolated from each other.

The mill throughput can be varied by varying a number of parameters.

These are essentially the number, size and position of the slots 14; and in particular the height of the non-slotted peripheral band of the wall 12, and the number, shape and size of the blades 16 and their radial position in relation to the proportion of bypass and thus their transfer capacity.

In a preferred embodiment of the invention the last chamber of the micronizing mill is separated from discharge by a separator baffle provided with wall 12 in which the non-slotted peripheral band is of substantially lesser height than in the other baffles so that the ground product has a lesser level and is all contained within the grinding load, which acts a a filter and prevents discharge of particles outside the size range.

To illustrate the advantages obtainable by the present invention, some coal wet-grinding tests carried out on a pilot micronizing mill constructed according to the present invention are described.

EXAMPLE 1

The product to be ground was coal, grinding being effected with separate feeds of dry coal and water in a weight ratio of about 1:1.

The pilot mill comprised 3 chambers of useful inner diameter, not including the armour cladding, of 550 mm and a total useful length, not including the baffles, of 3300 mm divided as follows: first chamber 760 mm, second chamber 1780 mm, third finishing chamber 760 mm.

Figure 2A:
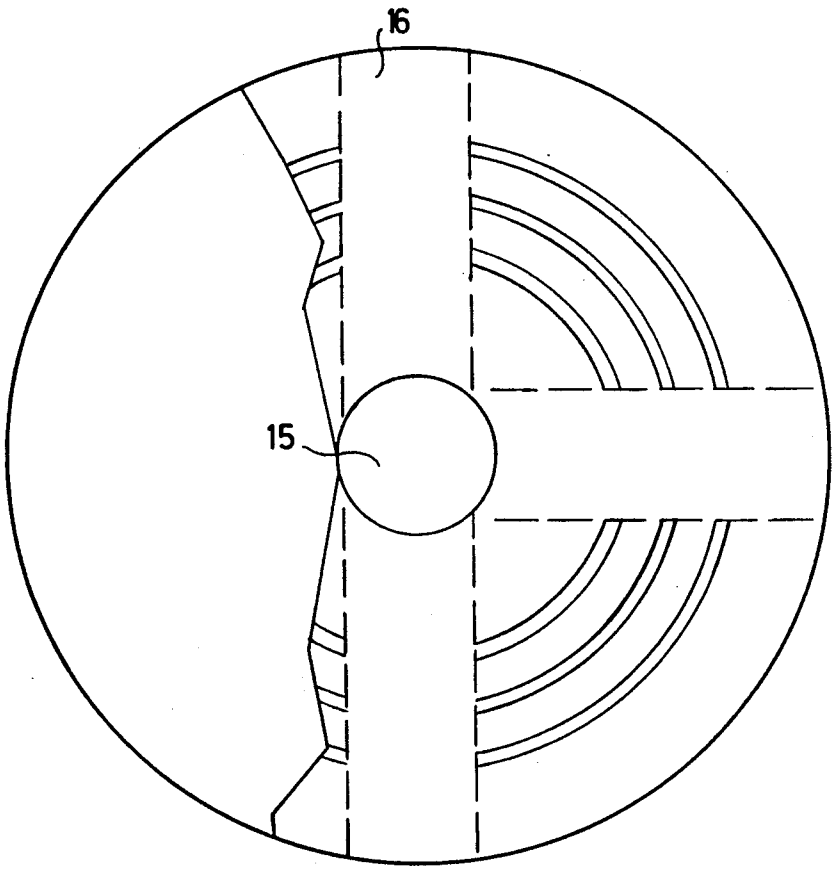
FIG. 2A is a detailed illustration of separator baffles of a micronizing mill with a view perpendicular to the rotational plane of the baffle.

The separator baffles were of the shape shown in FIGS. 2A and 2B and had the following characteristics:

| | |
|---|---|
| 1st baffle: ratio of passage area to total area | 3% |
| height of slots | 8 mm |
| height of non-slotted circular band | 86 mm |
| No. of blades | 4, C-shaped |
| 2nd baffle: ratio of passage area to total area | 2% |
| height of slots | 5 mm |
| height of non-slotted circular band | 86 mm |
| No. of blades | 4, C-shaped |
| 3rd baffle (discharge): ratio of passage area to total area | 2.9% |
| height of slots | 5 mm |
| height of non-slotted circular band | 69 mm |
| No. of blades | 4, C-shaped |
| Speed of rotation: | 37 r.p.m. equivalent to 65% of the critical speed. |

The grinding load was as follows:

1st chamber: steel balls with the following weight distribution:

| | |
|---|---|
| 30 mm dia. | 13% |
| 25 mm dia. | 25% |
| 20 mm dia. | 25% |
| 15 mm dia. | 37% |

2nd chamber: steel balls with the following weight distribution:

| | |
|---|---|
| 15 mm dia. | 24% |
| 10 mm dia. | 76% |

The degree of filling maintained in the grinding chambers was as follows:

| | grinding load | product |
|---|---|---|
| 1st chamber | 36% | 29% |
| 2nd chamber | 36% | 35% |
| 3rd chamber | 34% | 28% |

The obtained performance was as follows:

| | |
|---|---|
| Particle size of coal feed | 0–6 mm |
| Bond index | 21 kWh/t |
| Dry throughput | 53 kg/h |
| Max product size | <20 microns |

-continued

| | |
|---|---|
| Electricity consumption | 100 kWh/t dry basis |

EXAMPLE 2

The same mill was used to micronize coal of finer particle size, fed in suspension.

The first separator baffle was removed. The grinding load and the degree of filling were the same as in the second and third stages of the preceding example.

The obtained performance was as follows:

| | |
|---|---|
| Particle size of coal feed | 0-350 microns |
| Bond index | 21 kWh/t |
| Feed throughput | 110 kg/h of turbid liquid containing 49% by weight |
| Max ground product size | <20 microns |
| Electricity consumption | 65 kWh/t dry basis |
| Speed of rotation | 37 r.p.m. eqivalent to 65% of critical speed. |

Tests were also carried out on another pilot mill to determine the effect of the L/D ratio on the ground product, by reducing the useful length of the device. The tests were carried out using separate dry material and water feeds.

EXAMPLE 3

| | $L_{tot}/D = 4$ | $L_{tot}/D = 6$ |
|---|---|---|
| Inner diameter | 600 mm | 600 mm |
| Useful length | 2400 mm | 3600 mm |
| No. of chambers | 2 | 2 |
| Useful length 1st chamber | 560 mm | 830 mm |
| Grinding bodies 1st chamber | as 1st chamber of Example 1 | |
| Useful length 2nd chamber | 1840 mm | 2770 mm |
| Grinding bodies 2nd chamber | as 2nd chamber of Example 1 | |
| Coal feed | | |
| Particle size | 0-6 mm | 0-6 mm |
| Bond index (kWh/t) | 21 | 21 |
| Throughput, dry basis (k/h) | 20.8 | 39 |
| Max. product size | <20 microns | <20 microns |
| Energy consumption (kWh/t) | 225 | 180 |
| Unit production ($kg/m^3 \cdot h$) | 30.8 | 38.3 |
| Speed of rotation (r.p.m.) | 35.5 | 35.5 |

EXAMPLE 4

| | $L_{tot}/D = 4$ | $L_{tot}/D = 6$ |
|---|---|---|
| Inner diameter | 600 mm | 600 mm |
| Useful length | 2400 mm | 1940 mm |
| No. of chambers | 3 | 3 |
| Useful length 1st chamber | 560 mm | 830 mm |
| Useful length 2nd chamber | 1280 mm | 3600 mm |
| Useful length 3rd chamber | 560 mm | 830 mm |
| Grinding bodies | as Ex. 1 | as Ex. 1 |
| Degree of filling | as Ex. 1 | as Ex. 1 |
| Coal feed | | |
| Particle size | 0-6 mm | 0-6 mm |
| Bond index (kWh/t) | 21 | 21 |
| Throughput, dry basis (kg/h) | 27 | 65 |
| Max. product size | <20 microns | <20 microns |
| Energy consumption (kWh/t) dry | 160 | 100 |
| Unit production ($kg/m^3 \cdot h$) | 39.8 | 64 |
| Speed of rotation (r.p.m) | 35.5 | 35.5 |

From Examples 3 and 4 it can be seen that the surprising production increase for fine particle sizes (<20 microns) obtained by the increased length far exceeds the consequent increase in useful volume.

There is also a considerable decrease in unit energy consumption with increase in the number of grinding chambers.

In the tests carried out it has also been found that maximum energy efficiency in the production of micronized material with a maximum size less than 20 microns is obtained within the speed range of 60-67% of the critical speed, the test range having been 40-80%.

Figure 3:
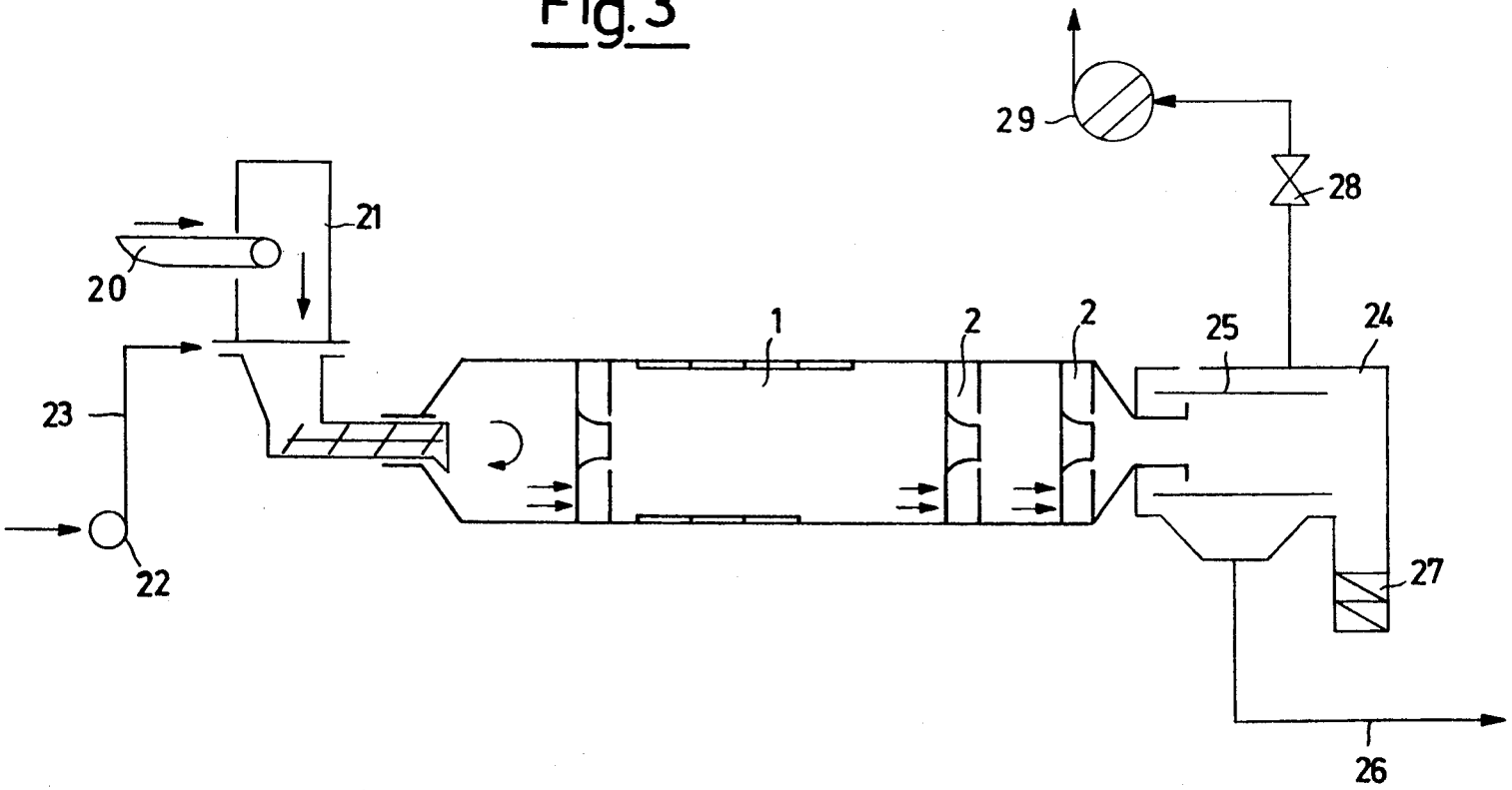
FIG. 3 is a schematic illustration of a side view of a micronizing mill having an extractor fan and additional components.

The micronizing mill according to the invention can be used industrially both for wet and for dry grinding. FIG. 3 shows a flow diagram for wet grinding. The granular coal is fed by the conveyor belt 20 to the mixer device 21 into which the suspension water is fed by the pump 22 and line 23. The suspension obtained is fed into the micronizing mill 1 according to the invention. It is discharged by the discharge device 24, consisting of a rotating structure with a perforated wall 25 which allows the micronized product suspension to pass and be removed via the line 26, while any undersized grinding bodies which have passed through the separator baffles 2 are discharged from its end. They are collected in a hopper 27 and are periodically removed. The energy consumed during grinding results in a temperature increase of the aqueous suspension and a certain formation of steam. The steam extraction rate and the product suspension temperature are controlled by the regulator valve 28 connected between the extractor fan 29 and the discharge device 24.

Figure 4:
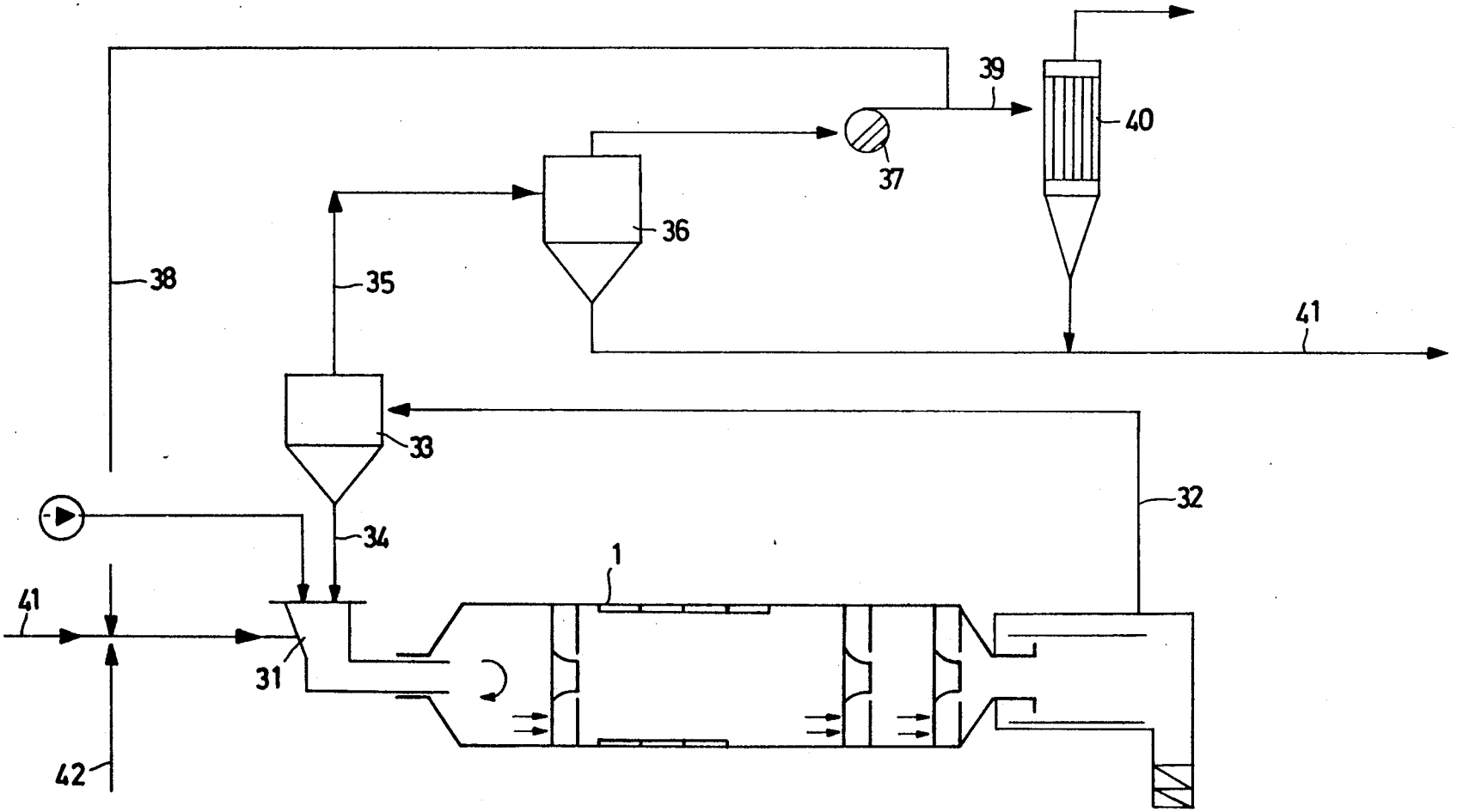
FIG. 4 is a schematic illustration of a side view of a micronizing mill with a cyclone separator and a recycle line.

FIG. 4 shows a process flow diagram for dry micronization coupled with a cyclone classifier. The granular feed and the recycled coarse product fraction are fed to the feed hopper 31 and drawn into the micronizing mill 1 of the present invention by suction. It is kept under vacuum and if necessary under a controlled atmosphere, this latter being the case if the material to be ground can form dust or volatile products which are dangerous in the presence of air, such as coal. This atmosphere can consist of air and inert gas mixtures of composition outside explosive limits.

By the effect of the suction, the micronized product is fluidized at the discharge and is fed through the line 32 to a first cyclone separator 33 which separates the coarser product fraction, this being recycled to the hopper 31 through the line 34. The finer fraction remains fluidized and is fed through the line 35 to a second cyclone separator 36 of higher efficiency, which separates the fine product fraction. The transport fluid leaves from the top of the cyclone 36 and is recycled to the hopper 31 by the suction fan 37, which compensates for the pressure drops in the overall circuit and the line 38.

Part of the fluidizing gas is discharged to atmosphere through the line 39 after final dust removal in the filter 40. The product is discharged through the line 41. Part of the fluidizing transport gas has to be discharged to keep its composition within safety limits, because a certain infiltration of external air is inevitable from the feed devices and through the rotary couplings. Air is fed through the line 41 and inert gas through the line 42. Operating the grinding process under vacuum prevents dust escaping into the atmosphere. To better emphasize the industrial advantages of the present invention, constructional and operational data are given below for a micronizing mill according to the invention designed for the wet grinding of coal, and in this case for processing granular fossil coal and petroleum coke, in accordance with the scheme of FIG. 3.

| Type | Fossil coat | Petroleum coke |
|---|---|---|
| FEED | | |
| Feed rate (t/h dry matter) | 20 | 20 |
| Moisture content (% by weight) | 5-10 | 6-11 |
| Density (kg/dm$^3$) | 1.35 | 1.4 |
| Grindability | | |
| H.G.I. (hardness index) | 5 | 55 |
| Bond index (kWh/t) | 21 | n.d. |
| Particle size distribution | equal for both | |
| Mesh size mm | Total retained % by weight | |
| 2 | average 1 | maximum 5 |
| 1.5 | average 5 | maximum 14 |
| 1 | average 15 | maximum 34 |
| 0.7 | average 30 | maximum 45 |
| 0.5 | average 45 | maximum 56 |
| 0.35 | average 60 | maximum 65 |
| 0.25 | average 73 | maximum 75 |
| mean diameter (mm) | average 0.6 | maximum 0.65 |
| INLET FLUID (added water) | | |
| Flow rate (t/h) | 22.7 | |
| Temperature (°C.) | 20-24 | |
| pH | 9-10 | |
| OUTLET FLUID | | |
| Suspension flow rate (t/h) | 42.1 | |
| Steam flow rate (t/h) | 1.7 | |
| Temperature (°C.) | 69 | |
| Concentration % by weight | 49-50 | |
| Viscosity (cP) | 80-180 | |
| pH | 7 | |
| Suspended solid | 99.5 passing 20 microns<br>all passing 32 microns | |
| MILL CHARACTERISTICS | | |
| Inner diameter nett of armour cladding | 3.1 m | |
| Total length of cylinder | 19.0 m | |
| Useful length of 1st chamber | 4.0 m | |
| Useful length of 2nd chamber | 9.5 m | |
| Useful length of 3rd chamber | 4.3 m | |
| Grinding load: | | |
| 1st chamber | 51 t | |
| 2nd chamber | 119 t | |
| 3rd chamber | 50 t | |
| Type, distribution and degree of filling | as Example 1 | |
| Installed power | 2700 kW | |
| Separator baffles: | | |
| Overall thickness 1st and 2nd baffle | 500 mm | |
| Overall thickness 3rd baffle | 250 mm | |
| No. of sectors and blades | 14 | |
| Slot height | as Example 1 | |
| Total slot area: | | |
| 1st chamber | 0.252 m$^2$ | |
| 2nd chamber | 0.154 m$^2$ | |
| 3rd chamber | 0.232 m$^2$ | |
| OPERATING DATA | | |
| residence time (minutes) | 36 | |
| Speed of rotation (r.p.m.) | 15.5 | |
| % critical speed | 65 | |
| Absorbed power (kW) | 2200 | |
| Energy consumption (kWh/t dry) | 110 | |

I claim:

1. A device for grinding granular material in a stream comprising:

a) a rotary drum having a plurality of successive grinding chambers wherein said rotary drum has a length to diameter ratio of at least 5;

b) hard solid grinding bodies located within each of the grinding chambers, wherein each grinding chamber of the rotary drum has a mixture of sizes of said grinding bodies, wherein said mixture of sizes comprises a mean particle size and wherein said mean particle size of said grinding bodies progressively decreases from one grinding chamber to another successive downstream grinding chamber; and c) a baffle wall within and connected to the rotary drum for separating the grinding chambers from one another, wherein said baffle wall comprises:

1) a first traverse wall connected to the rotary drum having an intermediate circular band of slots therethrough;

2) a second traverse wall having a central aperture and connected to the rotary drum, wherein said second wall is located downstream of said first wall;

3) transfer blades connected to said first and second walls and positions therebetween for moving the material through and within said baffle wall; and 4) a flared solid connected to said first and second walls and positioned therebetween, wherein said flared solid is coaxial with said central aperture of said second wall so that when the granular material is fed to the device, the granular material is ground in each successive grinding chamber by said grinding bodies and passed from each successive downstream grinding chambers through said baffle walls.

2. The device of claim 1 wherein the length to diameter ratio of the rotary drum is about 6.

3. The device of claim 1 wherein the rotary drum has more than two grinding chambers and wherein said intermediate circular band of slots in said first wall of the last of said baffle walls in the rotary drum is at a lower level than said intermediate circular band of slots in said first walls of other baffle walls in the rotary drum so that the level of the grinding bodies in the last grinding chamber is at a lower level than the grinding bodies in the other grinding chambers of the rotary drum.

4. The device of claim 1 wherein the plurality of grinding chambers comprise an initial grinding chamber, a final grinding chamber, and a central grinding chamber therebetween, wherein said central grinding chambers is larger than said initial and said final grinding chambers and wherein the device has a first baffle wall for separating said initial grinding chamber from said central grinding chamber and a last baffle wall for separating said central grinding chamber from said final grinding chamber.

5. The device of claim 4 wherein said grinding bodies in said final grinding chamber comprise 8 mm×8 mm steel rods.

6. The device of claim 4 wherein said grinding bodies in said central grinding chamber comprise the following distribution in size:

| | |
|---|---|
| 15 mm diameter | 24% |
| 10 mm diameter | 76% |

7. The device of claim 4 wherein said grinding bodies in said initial grinding chamber comprise the following distribution in size:

| | |
|---|---|
| 30 mm diameter | 13% |
| 25 mm diameter | 25% |
| 20 mm diameter | 25% |
| 15 mm diameter | 37% |

8. The device of claim 4 wherein the volume of said central grinding chamber is more than 50% of the total volume of all of the grinding chambers of the rotary drum.

9. The device of claim 4, wherein the size of said grinding bodies in said initial grinding chamber comprises the range of about 30 mm to about 15 mm; the size of said grinding bodies in said central grinding chamber comprises the range of about 15 mm to about 10 mm; and the size of said grinding bodies in said final grinding chamber comprises the range of about 8 mm.

10. The device of claim 9 wherein said grinding bodies comprise steel balls.

11. A device for grinding coal in a stream by a continuous cylindrical multicompartment grinding mill comprising a rotary drum divided into successive grinding compartments and separatory baffles separating each of said grinding compartments from the next successive compartment wherein each of said grinding compartments communicate with the next successive compartment through a central aperture; and an open frustoconical body positioned within said central aperture, wherein two adjacent grinding compartments contain grinding bodies of at least two different sizes and the last grinding compartment of said successive grinding compartments contains grinding bodies of the same size of about 15–30 mm in diameter, and wherein said separatory baffles comprise an upstream centrally perforated wall and a downstream perforated wall parallel said upstream wall and wherein said upstream wall has a plurality of perforations for providing supplementary communication between two adjacent grinding compartments; and wherein said separatory baffles further comprise a set of blades secured at one end to the peripheral wall of the mill and positioned within the grinding compartment.

12. The device of claim 11, wherein said grinding bodies of the last chamber comprise 8 mm diameter steel balls or 8 mm×8 mm steel rods.

13. The device of claim 11, wherein said grinding bodies in the second grinding compartment have the following size distribution:

| | |
|---|---|
| 15 mm diameter | 24% |
| 10 mm diameter | 76% |

14. The device of claim 11, wherein said grinding bodies contained in the first grinding compartment have the following size distribution:

| | |
|---|---|
| 30 mm diameter | 13% |
| 25 mm diameter | 25% |
| 20 mm diameter | 25% |
| 15 mm diameter | 37% |

* * * * *